United States Patent [19]

Ortolano

[11] Patent Number: 4,710,102

[45] Date of Patent: Dec. 1, 1987

[54] CONNECTED TURBINE SHROUDING

[76] Inventor: Ralph J. Ortolano, 3776 Coolheights Dr., Rancho Palos Verdes, Calif. 90274

[21] Appl. No.: 668,160

[22] Filed: Nov. 5, 1984

[51] Int. Cl.[4] ..... F01D 5/22

[52] U.S. Cl. ..... 416/190; 416/191; 416/196 R

[58] Field of Search ..... 416/190–192, 416/196 R, 500, 195

[56] References Cited

U.S. PATENT DOCUMENTS

| | | | |
|---|---|---|---|
| 777,432 | 12/1904 | Richter | 416/190 |
| 835,471 | 11/1906 | Rotter | 416/192 |
| 977,300 | 11/1910 | Haines | 416/218 |
| 991,296 | 5/1911 | Haines | 416/218 |
| 1,371,328 | 3/1921 | Schneider | 416/191 |
| 1,502,904 | 7/1924 | Campbell | 416/191 |
| 1,639,247 | 8/1927 | Zoelly et al. | 416/190 |
| 2,963,272 | 12/1960 | Welsh | 416/191 |
| 3,279,751 | 10/1966 | Ortolano | 416/191 |
| 3,306,577 | 2/1967 | Sagara | 416/191 |
| 3,331,166 | 7/1967 | Brenning | 51/217 |
| 3,417,964 | 12/1968 | Ortolano . | |
| 3,584,971 | 6/1971 | Ortolano | 416/218 |
| 3,588,278 | 6/1971 | Ortolano et al. | 416/190 |
| 3,606,578 | 9/1971 | Ortolano | 416/191 |
| 3,702,221 | 11/1972 | Ortolano | 416/191 |
| 3,728,044 | 4/1973 | Fujita et al. | 416/196 R X |
| 3,795,462 | 3/1974 | Trumpler, Jr. | 416/196 |
| 3,981,615 | 9/1976 | Krol | 416/190 |
| 3,986,792 | 10/1976 | Warner | 416/192 X |
| 4,076,455 | 2/1978 | Stargardter | 416/191 |
| 4,128,929 | 12/1978 | DeMusis | 29/156.8 B |
| 4,386,887 | 6/1983 | Ortolano | 416/190 |
| 4,400,915 | 8/1983 | Arrigoni | 51/217 R |
| 4,576,551 | 3/1986 | Olivier | 416/191 |

FOREIGN PATENT DOCUMENTS

| | | | |
|---|---|---|---|
| 606351 | 11/1934 | Fed. Rep. of Germany | 416/191 |
| 1340331 | 9/1963 | France | 416/191 |
| 1519898 | 2/1968 | France | 416/191 |
| 29506 | 3/1977 | Japan | 416/190 |
| 14803 | 2/1981 | Japan | 416/191 |
| 843278 | 8/1960 | United Kingdom | 416/196 R |
| 2072760 | 10/1981 | United Kingdom | 416/191 |

OTHER PUBLICATIONS

Turbo Machinery International, May–Jun., 1981, vol. 22, No. 5, p. 3.

*Primary Examiner*—Everette A. Powell, Jr.
*Attorney, Agent, or Firm*—Sheldon & Mak

[57] ABSTRACT

Turbine blades are held in long arc groups by a shroud structure, with gaps between segments of the shroud structure. These gaps are Z-shaped, the gaps tending to close due to untwisting of the blades when the blades are subjected to high centrifugal forces.

9 Claims, 2 Drawing Figures

CONNECTED TURBINE SHROUDING

BACKGROUND

Figure 1:
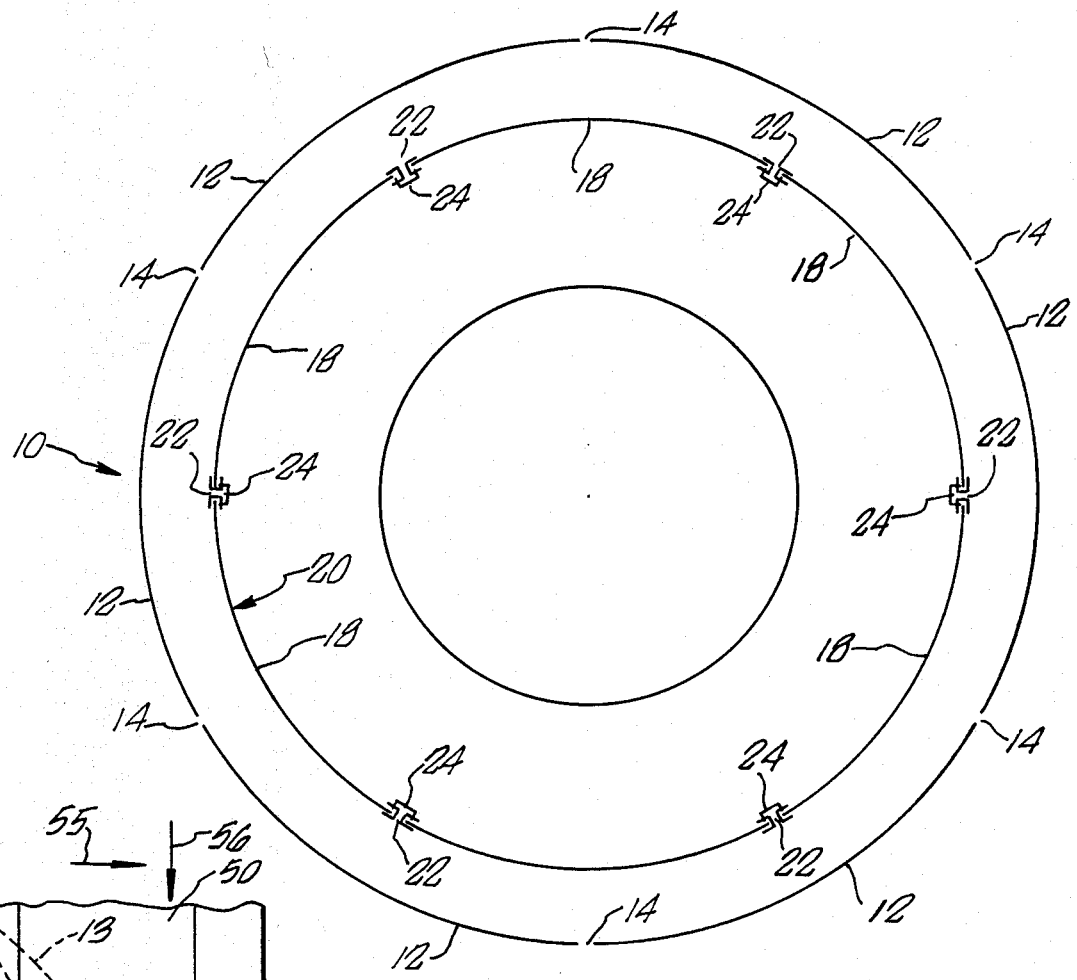

This invention relates to an elastic fluid axial flow turbine or compressor and, more particularly, to the shrouding used for the blading for such a turbine or compressor.

An elastic fluid axial flow turbine or compressor comprises a rotor having a peripheral groove and an annular row of blades having root portions disposed in the groove. A variety of blade structures are known and a variety of techniques for minimizing vibratory stresses in the blade structures have been developed. For example, U.S. Pat. No. 3,795,462 to Trumpler, Jr. describes the lashing of turbine blades into groups of three or more blades with a small V-shaped gap between the grooves. This gap tends to close due to untwisting of the blades when they are subjected to high centrifugal forces, thereby providing a substantially continuous lashing ring with vibration dampening characteristics.

A problem with short arc groups as shown by Trumpler is that low orders of harmonic excitation are insufficiently attenuated to prevent fatigue failure, particularly when wet and corrosive steam is used. To minimize this problem, the rotor blades have been connected together in long arc groups of more than 12 blades per group as described in my prior U.S. Pat. Nos. 3,588,278 and 4,386,887.

Although long arc shrouding has been successful in eliminating failure of untuned blading, failure of tuned blading can occur because of gaps between the groups of blades. It is necessary to leave gaps because of thermal and centrifugal stresses that develop in use. Because of the gaps, axio-torsional modes of vibration can develop high vibration amplitudes which can lead to failure of blading.

My prior U.S. Pat. No. 4,386,887 describes a solution to this problem, where the adjacent end blades of the long arc groups are flexibly tied together such as with S-shaped wire clips, pins, or sleeves. However, a problem with these connectors is that they introduce another element into the blade structure, thereby providing another element that can fail in use. Further, the pin or other tie means can work loose from the high stresses incurred by turbine blade structures.

Thus, there is a need for a technique for flexibly interconnecting the shroud segments of long arc groups together where the technique does not require additional parts that are subject to failure. Further, it would be desirable that the technique be useful for retrofitting existing turbines and compressors.

SUMMARY

The present invention is directed to a technique that satisfies these needs. According to the present invention a rotor structure for an axial flow elastic fluid utilizing machine comprises a rotor spindle, an annular row of radially extending blades carried by the rotor spindle, and an arcuate shroud structure attached to the radially outermost tips of the blades. The shroud structure connects the blades to each other in long arc groups comprising at least twelve blades. The shroud ring structure is divided into shroud segments, one segment for each long arc group. The shroud segments have a leading edge and a trailing edge. At least one pair of adjacent segments has their adjoining ends configured to be flexibly interlocked to each other without connectors. This is accomplished by having both of the adjoining ends include a section substantially parallel to the direction of rotation of the shroud. Preferably this section is at least ¼ inch long. Preferably all of the shroud segments have the leading and trailing edges so configured.

This can be accomplished by giving the adjoining ends a "Z" configuration that comprises two end sections transverse to the direction of the rotation of the shroud, the end sections being connected by the section that is substantially parallel to the direction of rotation of the shroud.

In operation of the machine, as the rotor rotates, centrifugal force tends to cause each long arc group of blades to untwist, with the gap between the shroud segments in the region of the middle section of the "Z" cut closing, thereby providing a continuous shroud structure which cooperates with the blade grouping to reduce vibration and to still allow for thermal expansion and elastic deformation of the rotor.

Moreover, this configuration reduces axiotorsional modes of vibration, without requiring any additional elements such as sleeves which can fail in use.

Further, this technique can easily be applied for modifying the rotor structure of an existing turbine or compressor. It is merely necessary to connect original shroud segments together, and then divide the shroud ring structure into new segments to provide long arc groups, with a "Z" cut end between adjacent segments.

DRAWINGS

Figure 2:
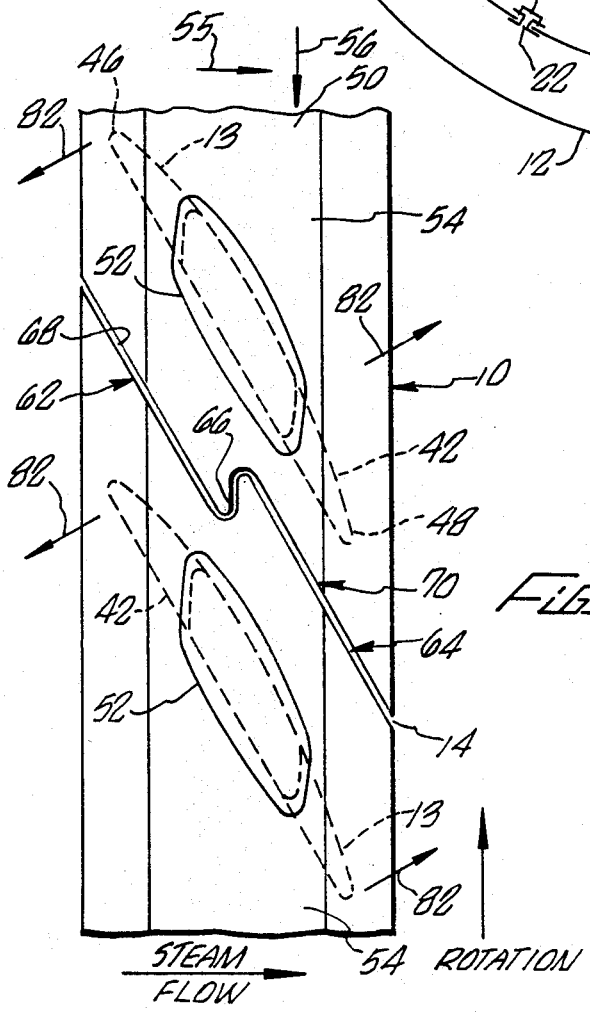

These and other features, aspects, and advantages of the present invention will become better understood with reference to the following description, appended claims, and accompanying drawings where:

FIG. 1 is a diagrammatic view of a blade structure having a shroud structure and a lashing structure for dividing the blades into long arc groups; and FIG. 2 is a plan view of adjacent end blades of two long arc groups of the rotor structure of FIG. 1 where the shroud segments of adjacent groups are interlocked with "Z-cut" ends.

DESCRIPTION

The present invention provides a rotor structure with substantially reduced axio-torsional modes of vibration without the use of connectors such as sleeves or wires in the shroud structure. The "tangential" mode of vibration is the in-phase vibration in the plane of maximum flexibility, perpendicular to the rotational axis of a rotor. The axial mode of vibration is the in-phase vibration in the direction of the axis of the rotor.

With reference to FIG. 1, there is shown diagrammatically a shrouded blade structure. As with a conventional compressor turbine, the blades 13 are carried by a rotor spindle (not shown). As described in U.S. Pat. No. 4,386,887, the blades at the tips are rigidly connected by an arcuate shroud ring structure 10 to form arcuate groups 12 of substantially equal central angular extent in degrees. The blades are susceptible to vibrate in a tangential in-phase mode having a resonant frequency at least that of the rated maximum running speed of the rotor. To reduce the tangential mode vibrations, the shroud structure 10 divides the blade groups 12 into a number equal to the resonant frequency divided by an integer multiple, (i.e. 1, 2, 3, . . . ) of the rotor running speed. Each blade group 12 contains at least twelve blades and comprises an end blade 42 at each end of the group. As shown in FIG. 1, between the end blades of adjacent groups 12 there is a gap 14. With reference to FIG. 2, the blades 13 are of usual air foil contour with a leading edge 46 and a trailing edge 48. The blades 42 are provided at their radially outermost tip with an integral blade cover or shroud 50 of arcuate shape. The shroud 50 is divided into shroud segments 54, one for each long arc blade group 12. The shroud segments 54 are held in place by tenon rivet buttons 52 usually formed from the tip portion of the blade foil 13. Steam flow in FIG. 2 is from left to right.

The blades 13 are also divided into inner long arc blade groups 18 by a lashing structure 20. The inner blade groups 18 have gaps 22 therebetween, with the end blades of the inner blade groups 18 secured together by connectors 24.

The direction of fluid flow is shown in FIG. 2 by arrow 55 with the resultant direction of rotation of the blades and shroud 50 shown by arrow 56.

The shroud segments 54 have an admission side diagonal end 62 and a discharge side diagonal end 64, the ends 62 and 64 of each adjacent pair of segments being separated by the gap 14. The adjoining ends of adjacent segments are configured to be flexibly interlocked to each other without connectors. This is accomplished by having each adjacent end include a web section 66, referred to below as a middle section, that is substantially parallel to the direction of rotation of the shroud, i.e. substantially perpendicular to the rotational axis of the rotor. As shown in FIG. 2, preferably the ends 62 and 64 have a "Z" configuration and comprise two end section 68 and 70 transverse to the direction of rotation of the shroud and connected by the middle section 66. Preferably the end sections 68 and 70 are straight, although they can be curved. It is important that the middle section of the gap be as small as possible, and preferably only from about 10 to about 40 mils wide, to be sure the gap closes in use. Preferably the ends of the middle section have generous radii.

In operation of the turbine, the gap between the diagonal ends 62 and 64 opens due to centrifugal growth. The blades tend to untwist due to centrifugal forces induced by rotating them with the groups tending to rotate as shown by arrows 82 in FIG. 2, thereby closing at least the middle section 66 of the gap 14. This produces a substantially continuous interlocking ring that results in significant vibration damping, which cooperates with the blade grouping, to minimize vibration of the blades and yet provide sufficient flexibility to allow for thermal and centrifugal expansion of the rotor.

The combined use of (1) rigidly attached harmonic arcuate blade groups and (2) flexible Z-cut interlocking shroud segments provides important advantages. In effect, a continuous tie is form and this insures that both tangential and axial modes of vibration are suppressed, and that the axio-torsional modes are limited to continuous tie amplitudes. Further, the design insures that the rotor has the capability to adjust for centrifugal and thermal distortion without excessive stress. Moreover, these objectives are accomplished without the need for additional connecting elements that might come adrift.

It is important that the middle leg be substantially parallel with the direction of rotation of the shroud structure. This is because a V-shaped gap with legs transverse to the direction of rotation of the shroud structure as taught by Trumpler would not be effective with long arc groups. The inability of V-shaped gaps to function as desired is due to the gaps opening up during use of the turbine or compressor from centrifugal and thermal growth of the rotor. The total circumferential growth can be approximately 0.25 inch. For a typical rotor row having 100 blades in short groups, this growth is not a problem and a Trumpler design would be effective where there are a large number of gaps because the blades are in short groups. For example, on a 100 blade row with short arc grouping of four blades per groups, there are 25 groups and thus each gap opens only 0.01 inch (0.250 divided by 25). But for harmonic arc groups, there typically are about four segments, and thus four gaps. Each of these gaps opens about 0.062 inch (0.250 divided by 4). It is likely that the blades would not untwist in use a sufficient amount (i.e. at least 0.062 inch) that a Trumpler V-shaped gap would close.

An advantage of the present invention is that it can be used easily with existing structures. As a first step, any gaps in the shroud of the existing blading are welded together. Then the requisite Z-cuts are made into the shroud at locations other than where the original gaps were present. The Z-cuts can be formed with an electrostaticdischarge machine (EDM). Alternatively, the transverse legs of the Z-cut can be formed with a hacksaw or radiac$_{TM}$ wheel, and the middle section gap produced by a series of drilled holes. In use of the blade structure, the non-drilled portion (ligaments) of the middle section of the Z-cut break open.

Although the present invention has been described in considerable detail with reference to certain preferred versions thereof, other versions are possible. For example, the Z cuts can be supplemented with S hooks as described in my U.S. Pat. No. 4,386,887. In addition, a tie wire system also can be used as described in my copending patent application entitled "Sleeve Connectors for Turbines", Ser. No. 656,187 filed on Oct. 1, 1984 which issued as U.S. Pat. No. 4,662,824 on May 5, 1987, which is incorporated herein by this reference. Therefore, the spirit and scope of the appended claims should not necessarily be limited to the description of the preferred versions contained herein.

What is claimed is:

1. A rotor structure for an axial flow elastic fluid utilizing machine comprising:

(a) a rotor spindle;

(b) an annular row of radially extending blades carried by the rotor spindle; and (c) a non-integral arcuate shroud ring structure, attached to the radially outermost tips of the blades for rigidly connecting the blades to each other in long arc groups comprising at least 12 blades, the shroud ring structure being divided into shroud segments with gaps therebetween, one shroud segment for each group, the long arc groups being of substantially equal central angular extend, the number of long arc groups being equal to the blade resonant frequency divided by an integer multiple of the rotor running speed; the blade tips being skewed relative to the direction of rotation of the shroud, the shroud segments having a leading end and a trailing end, at least one pair of adjacent segments having their adjoining ends configured to be flexibly interlocked to each other without connectors at a gap that is completely between blade tips, with the adjoining ends having a "Z" configuration comprising two end sections connected by a section substantially parallel to the direction of rotation of the shroud, the two end sections being transverse to the direction of rotation of the shroud, such that when the machine is in operation, the blades tend to untwist resulting in the gap closing in the middle section of the "Z" configuration.

2. The rotor structure of claim 1 in which all adjoining ends have the "Z" configuration.

3. The rotor structure of claim 1 wherein the adjacent segments are separated from each other by about 10 to about 40 mils.

4. The rotor structure of claim 1 in which the section substantially parallel to the direction of rotation of the shroud is at least ¼ inch long.

5. The rotor structure of claim 1 wherein each blade is attached to the shroud by a single tenon.

6. The structure of claim 1 in which the "Z" configuration consists only of three sections the two end sections and the section substantially parallel to the direction of rotation of the shroud.

7. The rotor structure of claim 1 wherein the row of blades is further divided by a lashing structure into inner long arc groups each comprising at least 12 blades, the lashing structure being located between the blade tips and the rotor spindle, the inner blade groups having gaps therebetween, the gaps between the inner blade groups and the gaps between the shroud segments being offset from each other circumferentially, with the end blades of the inner blade groups being secured together by connectors.

8. The rotor structure of claim 1 further comprising a lashing structure connecting the blades to each other in lashed groups which comprise at least three blades and including an end blade at each end of the lashed group, the lashing structure comprising: (i) a lashing wire for each lashed group; and (ii) a sleeve connecting the lashing wires of each pair of adjacent groups while maintaining a gap between adjacent lashing wires, at least one gap between adjacent lashing wires being at least partially filled in by first solid fill material not integral with the sleeve.

9. The rotor structure of claim 1 further comprising a lashing structure connecting the blades to each other in lashed groups which comprise at least three blades and include an end blade at each end of the lashed group, the lashing structure comprising (i) a lashing wire for each group, (ii) a first type of sleeve connecting the lashing wire of one pair of adjacent lashed groups, while maintaining a gap between adjacent lashing wires, the first type of sleeve having two in-line axial holes separated by a barrier wall with the lashing wires in the axial holes being separated apart by the barrier wall, the barrier wall being integral with the sleeve; and (iii) a second type of sleeve connecting the lashing wires of all the other pairs of adjacent lashed groups to maintain gaps between adjacent lashing wires, the second type of sleeve having an axial hole therethrough and a radial hole extending into the axial hole, a portion of the axial hole containing fill material not integral with the sleeve for maintaining a gap between adjacent lashing wires, the fill material having been introduced into the second type of sleeve through the radial hole, and the fill material is capable of being removed from the second type of sleeve, wherein the radial hole faces towards the rotor spindle.

* * * * *

UNITED STATES PATENT AND TRADEMARK OFFICE

CERTIFICATE OF CORRECTION

PATENT NO. : 4,710,102

DATED : December 1, 1987

INVENTOR(S) : Ralph J. Ortolano

It is certified that error appears in the above-identified patent and that said Letters Patent is hereby corrected as shown below:

In The Specification:

Column 3, line 54, change "form" to --formed--.

In The Drawings:

Figure 2: Arrow 56 is deleted. Instead, a new numeral 56 is added to refer to the arrow on the bottom right corner which is marked with the word "rotation", indicating the direction of the resultant rotation of the blades and shroud.

Signed and Sealed this

Seventh Day of February, 1989

*Attest:*

*Attesting Officer*

DONALD J. QUIGG

*Commissioner of Patents and Trademarks*